US010022770B2

(12) United States Patent
Grimm

(10) Patent No.: US 10,022,770 B2
(45) Date of Patent: Jul. 17, 2018

(54) METHOD AND TOOL FOR PRECISION CUTTING

(75) Inventor: Willi Grimm, Kallnach (CH)

(73) Assignee: Feintool International Holding AG, Lyss (CH)

( * ) Notice: Subject to any disclaimer, the term of this patent is extended or adjusted under 35 U.S.C. 154(b) by 648 days.

(21) Appl. No.: 12/223,570

(22) PCT Filed: Feb. 2, 2007

(86) PCT No.: PCT/EP2007/001106

§ 371 (c)(1),
(2), (4) Date: Aug. 4, 2008

(87) PCT Pub. No.: WO2007/090658

PCT Pub. Date: Aug. 16, 2007

(65) Prior Publication Data

US 2009/0010723 A1 Jan. 8, 2009

(30) Foreign Application Priority Data

Feb. 3, 2006 (EP) ..... 06090018

(51) Int. Cl.
*B21D 28/16* (2006.01)
*B21D 28/26* (2006.01)

(52) U.S. Cl.
CPC ..... *B21D 28/16* (2013.01); *B21D 28/26* (2013.01); *Y10T 407/245* (2015.01)

(58) Field of Classification Search
CPC ..... B21D 52/28; B21D 28/16; B21D 28/30; B21D 28/18; B26D 1/08
(Continued)

(56) References Cited

U.S. PATENT DOCUMENTS 795,794 A * 7/1905 Gaines ..... 470/162
887,630 A * 5/1908 Hart ..... 470/163
(Continued)

FOREIGN PATENT DOCUMENTS

CH 665 367 5/1988
DE 3506035 A1 * 8/1986 ..... B21K 1/30
(Continued)

OTHER PUBLICATIONS

Machine Translation of CH 665367.*
(Continued)

*Primary Examiner* — Jennifer Swinney
(74) *Attorney, Agent, or Firm* — Norris McLaughlin & Marcus, P.A.

(57) ABSTRACT

A method and tool for producing workpieces with small corner radii in relation to the cutting thickness and with greatly reduced draw-in by precision cutting in a precision cutting tool includes clamping the workpieces between two tool parts consisting of a respective top and bottom cutting dies and of a top and a bottom cutting punch. The workpiece is machined in a one-stage arrangement in at least two successive cutting sequences in different cutting directions with the following partial steps: (A) cutting out a semifinished product, matched to the workpiece geometry, in a first cutting operation in a vertical working direction with slight draw-in, and (B) finish cutting of the semifinished product, produced in step (A), in at least one further cutting operation in a working direction opposed to step (A), wherein the draw-in of partial step (A) is filled again at least in the corner region.

5 Claims, 7 Drawing Sheets

State of the Art

(58) Field of Classification Search
USPC ..... 83/687, 691, 552, 555, 554, 578, 622, 83/621; 470/162, 163
See application file for complete search history.

(56) References Cited

U.S. PATENT DOCUMENTS

| | | | | | |
|---|---|---|---|---|---|
| 1,428,174 | A * | 9/1922 | Luther | 83/124 | |
| 3,564,959 | A * | 2/1971 | Harada | 83/124 | |
| 3,568,554 | A * | 3/1971 | Wiechec | 83/98 | |
| 3,570,343 | A * | 3/1971 | Wolnosky et al. | 83/124 | |
| 3,650,167 | A * | 3/1972 | Hoffmeyer et al. | 83/41 | |
| 3,688,549 | A * | 9/1972 | Ohnishi et al. | 72/334 | |
| 3,878,746 | A * | 4/1975 | Carmeli | 83/126 | |
| 3,919,909 | A * | 11/1975 | Scott | 83/530 | |
| 4,477,537 | A * | 10/1984 | Blase et al. | 428/577 | |
| 4,509,353 | A * | 4/1985 | Ike et al. | 72/267 | |
| 5,247,862 | A * | 9/1993 | Haack | B21D 28/16 | 83/124 |
| 5,413,018 | A * | 5/1995 | Wada et al. | 83/456 | |
| 5,732,587 | A | 3/1998 | Maeda et al. | | |
| 6,125,527 | A * | 10/2000 | Sunaga et al. | 29/558 | |
| 6,622,908 | B2 * | 9/2003 | Fukumoto et al. | 234/98 | |
| 7,464,575 | B2 * | 12/2008 | Miyahara | 72/329 | |
| 2001/0039865 | A1 * | 11/2001 | Bennett | B21D 28/16 | 83/124 |
| 2003/0066329 | A1 | 4/2003 | Aizaki | | |

FOREIGN PATENT DOCUMENTS

| | | | |
|---|---|---|---|
| EP | 864384 | A2 * | 9/1998 |
| EP | 1 815 922 | | 8/2007 |
| JP | 01237040 | A * | 9/1989 |
| JP | 04028427 | A * | 1/1992 |
| JP | 06015381 | A * | 1/1994 |
| JP | 2006224143 | A * | 8/2006 |
| WO | WO 02/081116 | | 10/2002 |
| WO | WO 02081116 | A1 * | 10/2002 |
| WO | WO-2007/090658 | | 8/2007 |

OTHER PUBLICATIONS

English Translation of JP64-237040 (which is JP01237040).*
2007 "Umformen and Feinschneiden" R.-A. Schmidt et al. Hanser pp. 144-173.

* cited by examiner

State of the Art

State of the Art

Partial Step A

Partial Step B

METHOD AND TOOL FOR PRECISION CUTTING

BACKGROUND OF THE INVENTION

The invention relates to a method for manufacturing workpieces with small corner radii in relation to the thickness to be cut, and greatly reduced edge reduction in a fine blanking tool of a fine blanking machine, wherein the workpiece is clamped between two tool parts respectively consisting of an upper and a lower cutting die, as well as of an upper and a lower cutting punch, and the cutting is realized by the combined efforts of upper and lower cutting punches.

The invention further relates to a tool for fine blanking of workpieces with small corner radii in relation to the thickness to be cut, and greatly reduced edge reduction, from a cutting strip, a sheet, a coil material or the like, with two clamping the latter tool halves respectively consisting of at least one cutting die and one cutting punch.

The limitations of fine blanking of portions with small corner radii in relation to the thickness of the sheet to be cut and to the quality of the material are sufficiently known. Based on experience, a fine blanking severity is defined which distinguishes the severity degrees Si (easy), S2 (medium) and S3 (difficult) (see "Umformen and Feinschneiden", in Handbuch fur Verfahren, Werkstoffe, Teilegestaltung, pages 154 to 165, Verlag Hallwag AG, 1997, Switzerland). Thus, the severity degree is essentially defined by the cutting path geometry and the thickness of the metal sheet. For this, the cutting path geometry is divided into simple geometric basic areas such as corner radii, hole diameters, groove and fin widths. From the ratio between a geometric dimension and the thickness of the metal sheet, the severity degree of fine blanking is defined, which grows with growing metal sheet thickness. That means that fine blanking of large-area thin parts is easier than fine blanking of narrow fins or rings with greater sheet thickness. Also, obtuse-angled corners with big radii are to be cut better than sharp-cornered structure with small radii.

A method is known from DE 39 31 320 C1 for manufacturing burr-free workpieces by punch counter cutting, for example, in an fine blanking tool, wherein a cutting strip from which the workpiece is to be cut is clamped between two tool parts, respectively consisting of an upper and a lower cutting die as well as of an upper and a lower cutting punch, and the cutting is realized by the combined efforts of upper and lower cutting punches, wherein cutting of the workpiece is started along a cutting line and then the workpiece is cut out in the opposite direction.

This state of the art exactly shows the intended reduction on both sides as a result of counter cutting.

Typical characteristics of fine blanking parts are edge reduction and burr. Especially at corner portions, edge reduction occurs, which grows with corner radii becoming smaller and with increasing sheet thickness. The reduction depth may be about 20% and the reduction width may be 30% of the sheet thickness or more (see DIN 3345, Feinschneiden; August 1980). Thus, this reduction depends on the thickness and quality of the material, so that controlling it is possible only in a limited way, and often results in limited functioning of parts, for example, because of lack of sharp-edged tips of interlocking parts or because of the changes in the functional length of parts.

At this state of the art, it is an object of the invention to improve a method and a tool for manufacturing workpieces in such a way that fine blanking can be also applied for parts with small corner radii and sharp-edged corners with greater sheet thickness, without limiting the function of the parts and at the same time providing economic advantages.

SUMMARY OF THE INVENTION

This object is achieved by a method of the kind mentioned above, in accordance with which.

In accordance with the invention, fine blanking becomes economically applicable also for portions of parts with small corner radii and sharp edge portions, for example, interlocking parts with greater thickness. The approach according to the invention is based on the principle of different cutting directions of the geometries of parts converging without corner radius.

Thus, the part to be cut at least consists of two cutting geometries, for example a circular geometry and a toothed geometry, wherein the process of fine blanking is executed in a one-stage arrangement. In a first partial step, the addendum circle structure of the interlocking part is cut out of the cutting strip in vertical working direction. It follows the cutting out of the blank spaces between the teeth in a working direction opposite to the first partial step.

The special advantage of the method according to this invention is that the converging tool geometries are not pressure loaded at the same time and not in the same direction. The pressure loads in the corner area of the workpieces thus can be significantly decreased, so that complex part geometries also of greater thickness can be fabricated by fine blanking with sharp edges, massively reduced rollover and precise functional length.

Because of the specifically selected cutting geometry 20 of the first partial step it is contrived that the rollover is filled up again during the second partial step.

The method and tool according to this invention only require a one-stage arrangement and further makes it possible to minimize the application of multi-step fabrication processes, whereby the fine blanking process becomes more efficient also in case of parts with complex structure and greater thickness.

Further advantages and details accrue from the following description with reference to the attached figures.

In the following, the invention will be explained in more detail with reference to an example of an embodiment.

DETAILED DESCRIPTION OF THE INVENTION

With the method according to the invention, a workpiece 1 shall be fabricated, in this case, an interlocking part of greater thickness d, for example, 6.5 mm, by fine blanking the interlocking part out of a cutting strip 2. The principle layout of the fine blanking tool 3 corresponds to the known state of the art. Thus, a detailed description can be omitted. For this reason, only the special features of the tool will be emphasized in the following description.

Figure 1:
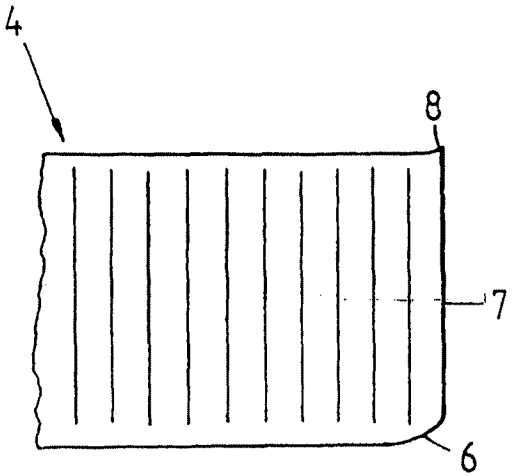
FIGS. 1 and 2 depict partially illustrated cross-sectional views of fine blanked parts according to the state of art of DE 39 31 320 C1.
Figure 2:
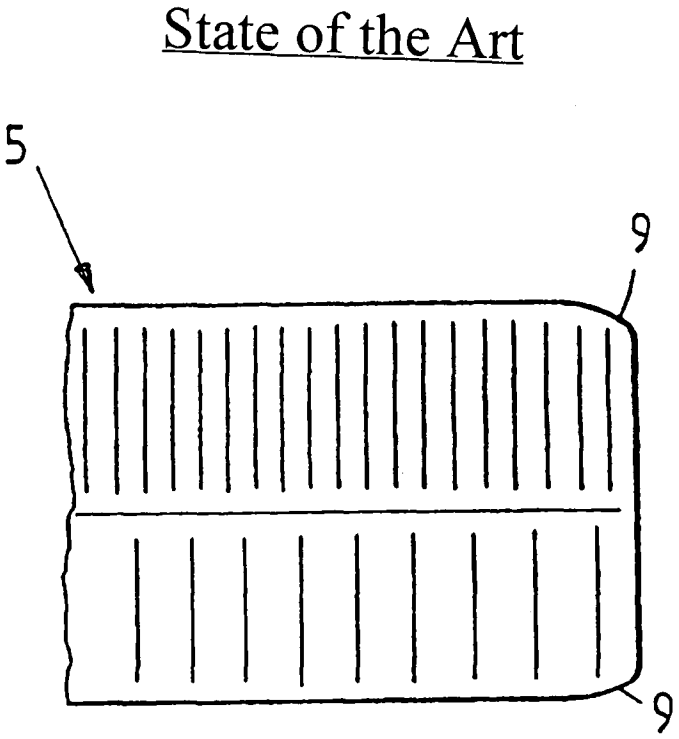

FIGS. 1 and 2 show the cutting geometry of a fine blanked and a counter fine blanked part 4 and 5, respectively, which is known from the state of the art according to DE 39 31 320 C1. The fine blanked part 4 has an edge reduction 6, a burnish 7 and a burr 8, wherein the burr 8 occurs on the side opposite to the edge reduction 6. It can be seen from the cutting geometry of the counter fine blanked part 5, that during counter fine blanking, an edge reduction 9 occurs on both sides, for which reason, parts with sharp edges, like, for example, interlocking parts, can not be fabricated with the necessary dimensional accuracy.

Figure 3:
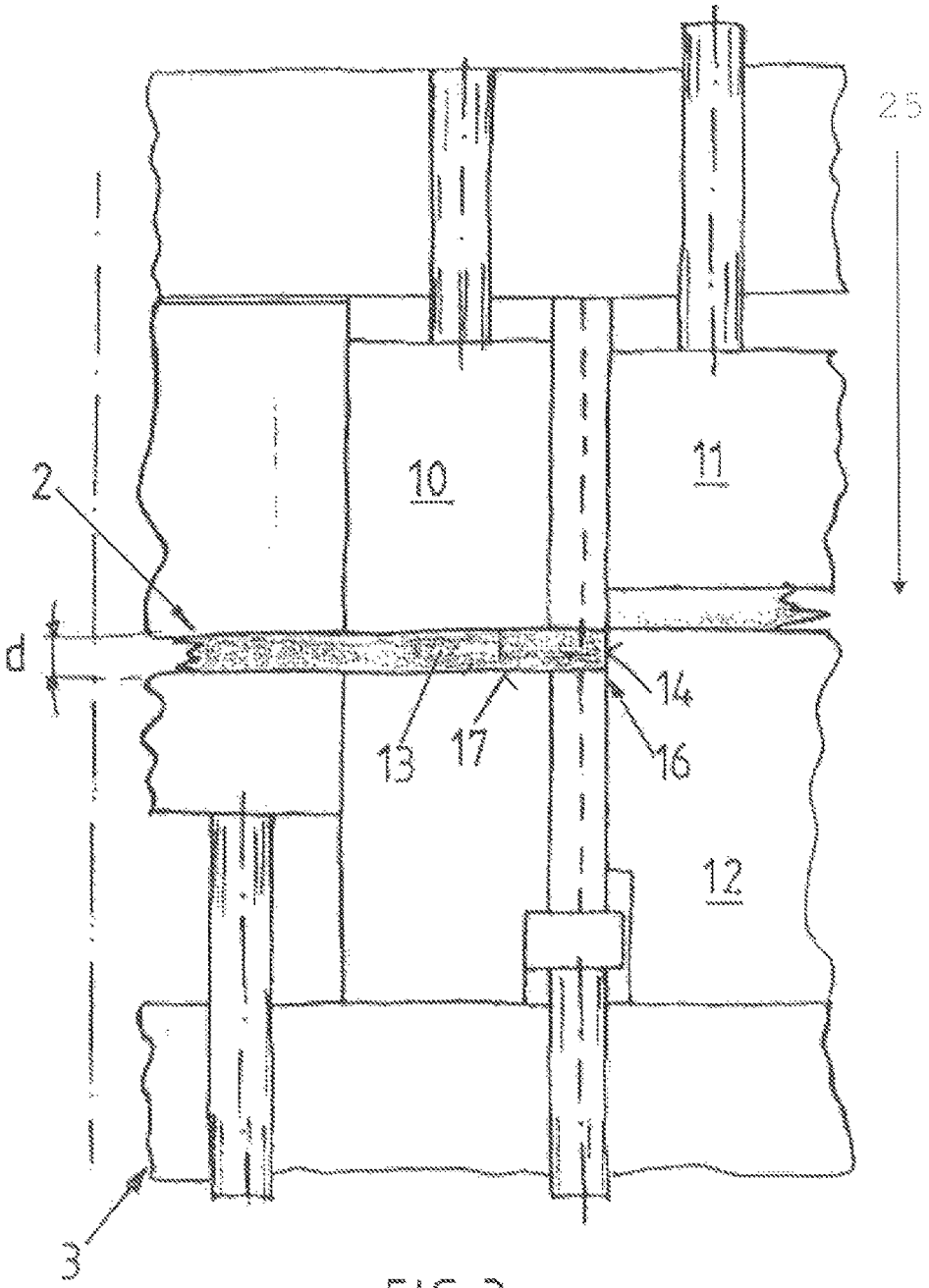
FIG. 3 is a simplified schematic view of the tool according to the invention during the execution of the first partial step of the method according to the invention.
Figure 4:
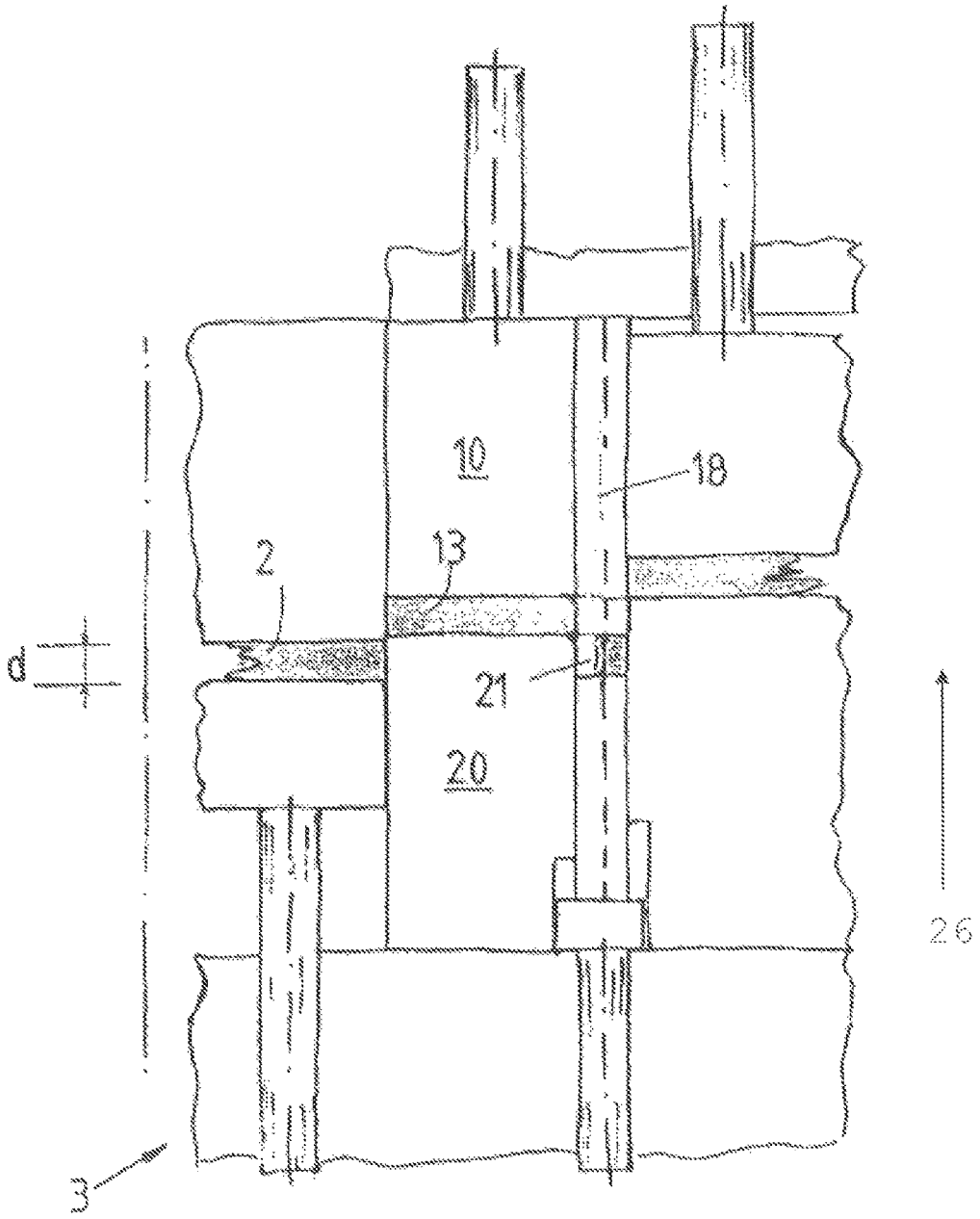
FIG. 4 depicts another simplified view of the method according to the invention during the execution of the second partial step of the method according to the invention.
Figure 5:
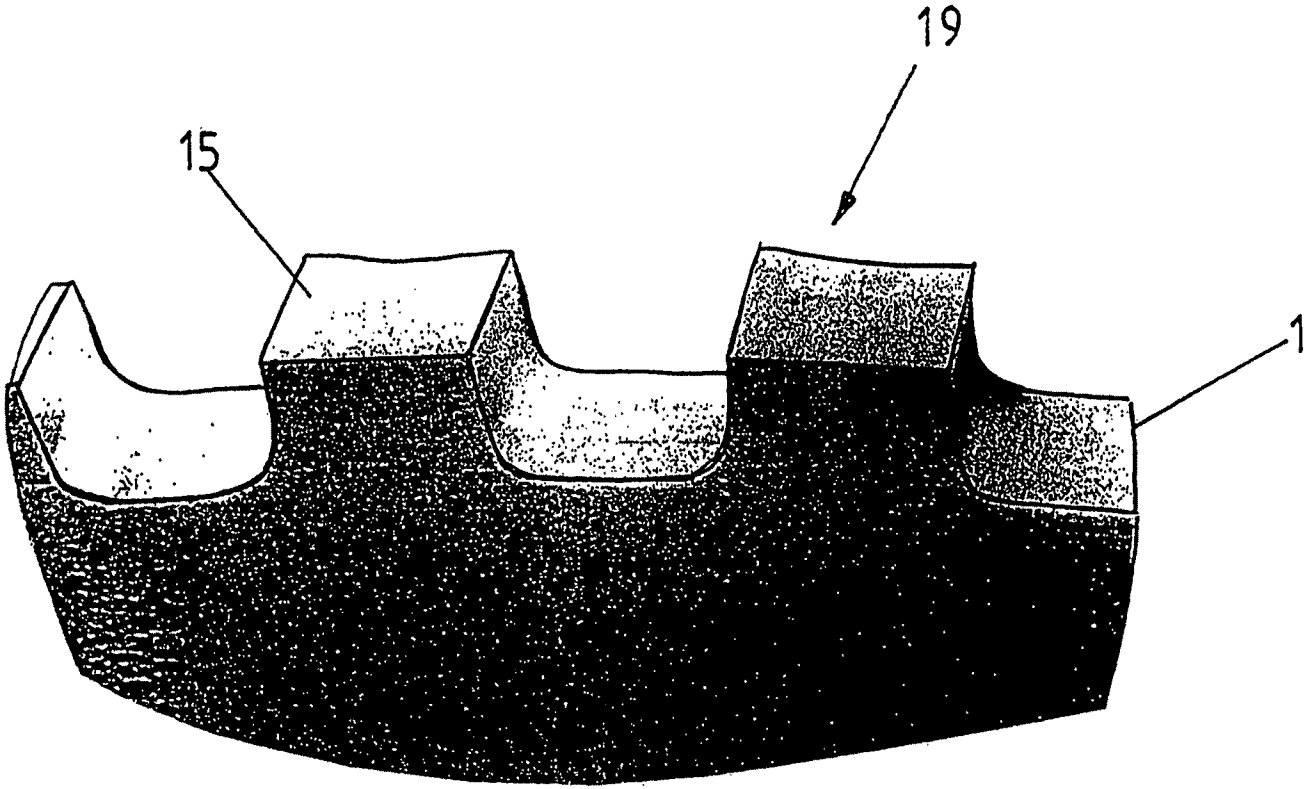
FIG. 5 shows the section of the cutting area geometry of an interlocking part produced according to the method of this invention as enlarged perspective view.
Figure 6:
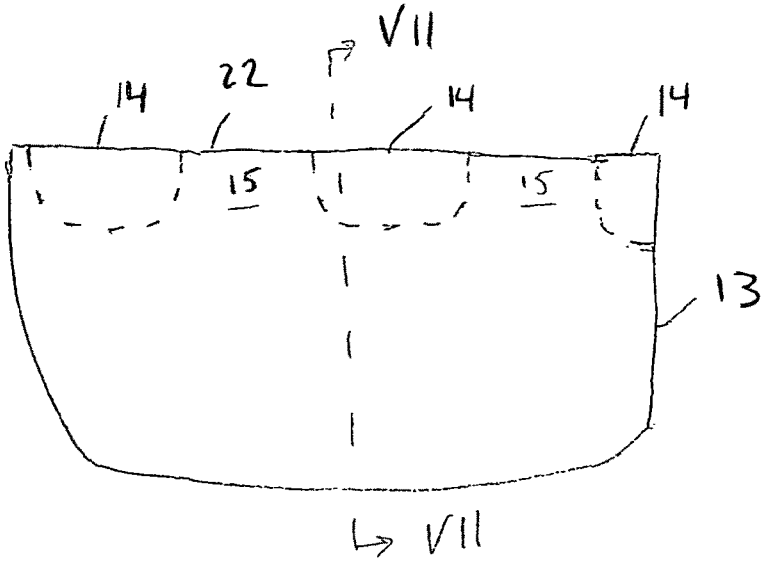
FIG. 6 is a front view of the interlocking part of FIG. 5 showing the addendum circle prior to cutting.

As shown in FIGS. 3-5, the fine blanking tool 3 has a multi-step main punch 10. The strip material 2 to be cut is clamped between a blank holder 11 and a blanking die 12. The ship material 2 has a thickness d, in this example, 6.5 mm. In a first partial step A, the main punch 10, the geometry of which respectively corresponds to the interlocking part 1 to be fabricated, cuts a blank 13 (semi-finished product) (see FIGS. 6-7) in a first vertical working direction 25 with an addendum circle 14 along a first cutting line 22 corresponding to the subsequent toothing 15, out of the strip material 2. The rollover 16 (see FIG. 7) at the addendum circle 14 of blank 13 is negligibly small and lies on side 17 of blank 13, which faces the applying main punch 10.

Figure 8:
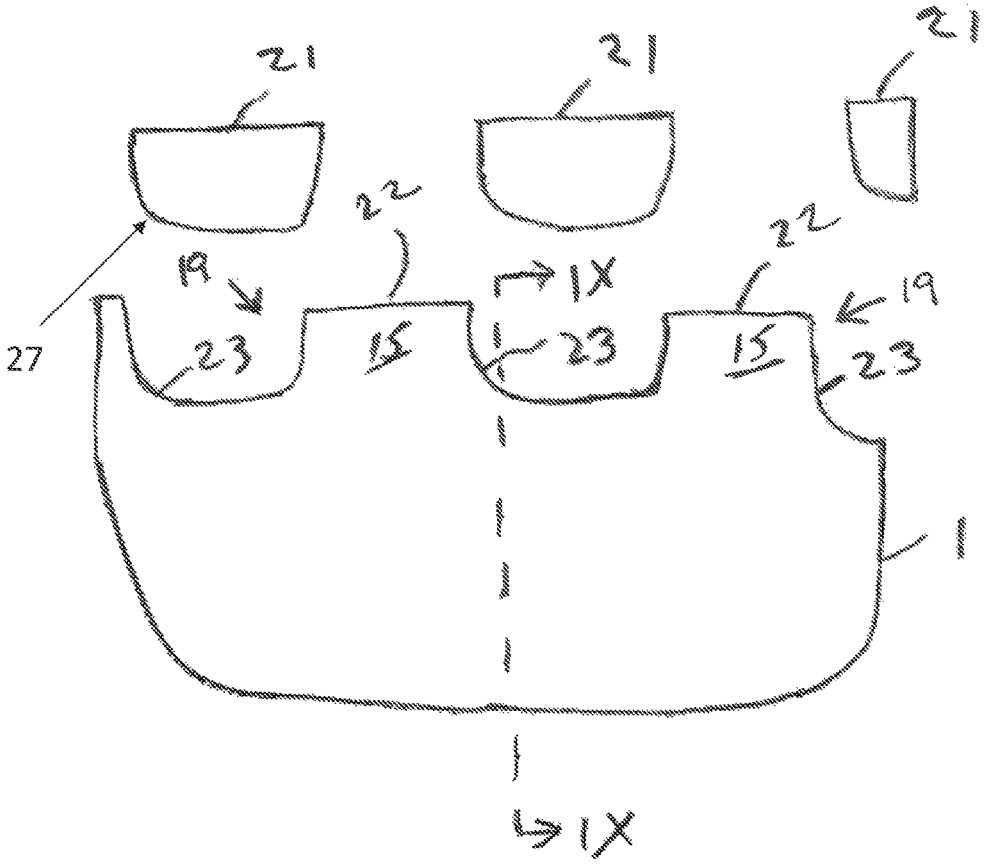
FIG. 8 shows a front view of the interlocking part with the teeth geometries cut out.

In a subsequent partial step B (see FIG. 4), the punches 18 (punches for cutting out the blanks between the teeth) for the final cut of the interlocking part 1, run back with the die plate 20, in the opposite direction (a second vertical working direction 26) to partial step A, after a working distance corresponding to the thickness d of the strip material 2 cut the teeth geometries 19 (see FIGS. 5 and 8) out of the blank 13 along second cutting lines 23, whereby the resulting waste portions 21 are also removed from the semi-finished product at an edge 27 formed during the cutting out of the semi-finished product.

Figure 7:
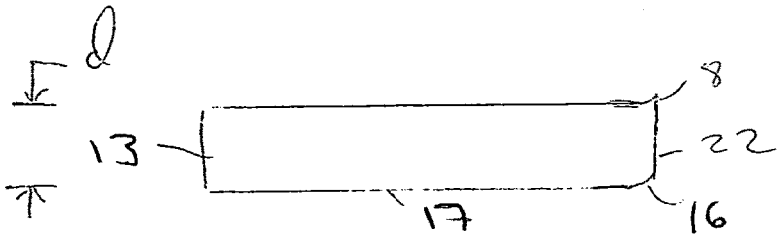
FIG. 7 shows a side view of the interlocking part showing rollover from cutting the blank.
Figure 9:
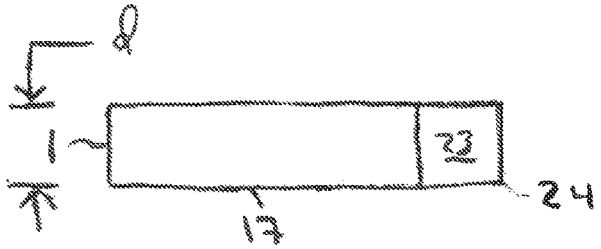
FIG. 9 shows the side view of FIG. 7 for the interlocking part after the teeth geometries are cut out.

The corner portions 24 of the rollover 16 from partial step A at intersections of the first cutting line and second cutting lines (i.e., at each tooth 19 distal end) is filled up again due to the cuts along the second cutting lines by punch 18 being from an opposite vertical cutting direction than the cut along the first cutting line by punch 10, (i.e., compare FIGS. 3 and 4 and compare FIGS. 7 and 9).

The cutting punch of the fine blanking tool 3 is designed as a multi-part main punch 10 for cutting out a first cutting geometry, for example, that of a blank 13. The diameter of the blank 13 corresponds to the diameter of the addendum circle of the toothing 15 of the interlocking part 1 to be fabricated. The working direction of the main punch 10 extends vertically. The main punch 10 is allocated at least one punch 18 (punch for cutting out the blanks between the teeth) for the final cut of the semi-finished product to receive the interlocking part 1. The punch 18 works in the opposite direction to the main punch 10 and with respect to the first cutting geometry it is arranged in a way that it can be applied to it without applying the pressure load in the same direction.

In the case of fabrication an interlocking part 1, the cutting geometry of the main punch 10 is an addendum circle. But it also can be a geometry consisting of a complex contour of steady or unsteady curves, if other parts with other complex shapes are to be fine blanked.

The punches 18 for the final cut advantageously have geometries of a contour with steady or unsteady curves.

Thereby, the cutting geometries of main punch 10 and punch 18 can be varied, so that complex parts can be composed of simple geometries, respectively.

The fine blanking tool 3 has a single-step structure. It facilitates contradirectional and directly adjoining cutting operations described above as partial steps A and B.

Thus, the converging tool geometries of main punch 10 and punch for cutting out the blanks between the teeth 18 are not subjected to pressure load at the same time and also not in the same direction, so that the otherwise necessary corner radius to reduce the partial compression tensions in the tip portions of the interlocking part can be dropped.

FIG. 5 shows as an example an interlocking part fabricated according to the method of the invention.

Thus, it is possible to produce complex workpieces or parts of greater thickness with sharp edges and significantly reduced rollover in a economically efficient way also by fine blanking.

The invention claimed is:

1. A method for manufacturing a workpiece comprising a part configured to interlock with another part and having small corner radii in relation to a thickness to be cut and greatly reduced edge reduction by fine blanking in a fine blanking tool of a fine blanking machine, the method comprising:

clamping the workpiece between two tool parts respectively consisting of an upper and a lower cutting die of the fine blanking tool, as well as of an upper cutting punch and a lower cutting punch of the fine blanking tool, wherein cutting is realized by combined efforts of said upper and lower cutting punches, cutting the workpiece in the fine blanking machine in at least two chronological cutting operations in different cutting directions without unclamping the workpiece between the two tool parts, said at least two chronological cutting operations comprising the following partial operations:

(A) with one of said upper and lower punches, cutting out a semi-finished product corresponding to a first geometry of the workpiece by cutting along a first cutting line comprising the first geometry of the workpiece in a first vertical working direction, said cutting resulting in rollover at the first geometry of the workpiece, wherein the first geometry of the workpiece is an addendum circle; and (B) with another of said upper and lower punches, final cutting of the semi-finished product, fabricated according to operation (A), to cut material from the semi-finished product and thereby refine the first geometry, said final cutting comprising cutting along a plurality of second cutting lines each having an end at the first cutting line and the second cutting lines each being oriented relative to the first cutting line so that each of the second cutting lines together with the first cutting line forms a respective corner of the part configured to interlock with another part, the corner having a radius which is small in relation to the thickness of the material, and said second cutting being in a direction opposite the direction of the cutting in operation (A) and wherein the other of said upper and lower punches contacts portions of the semi-finished product comprising the rollover resulting from operation (A) thereby to ameliorate the rollover resulting from operation (A).

2. A method according to claim 1, wherein converging tool geometries for the partial operations (A) and (B) are partitioned in a way that pressure loads are reduced at the corners of the workpiece.

3. The method according to claim 1, wherein said cutting out the semi-finished product corresponding to the first geometry comprises cutting out the semi-finished product completely from a source material.

4. The method according to claim 1, wherein said cutting out the semi-finished product corresponding to the first geometry comprises cutting out the semi-finished product completely from a source material along the addendum circle to achieve said first geometry, said first geometry being refined to achieve a geometry of a finished workpiece by cutting out additional material from the workpiece that was not cut out as part Of said cutting out the semi-finished product corresponding to the first geometry.

5. A method for manufacturing a workpiece comprising a part configured to interlock with another part and having corner radii which are small in relation to a thickness of a material from which the workpiece is to be manufactured and in which edge reduction is greatly reduced by fine blanking in a fine blanking tool of a fine blanking machine, the method comprising:

clamping the material between two tool parts respectively consisting of an upper and a lower cutting die of the fine blanking tool, as well as of an upper cutting punch and a lower cutting punch of the fine blanking tool, wherein cutting is effected by combined actions of said upper and lower cutting punches, cutting the material in chronological cutting operations in different cutting directions without unclamping the material between the two tool parts, said chronological cutting operations comprising the following:

(A) in a first cutting operation, with one of said upper and lower punches cutting out from the material a semi-finished product having a curved periphery having a curved contour, said first cutting including cutting along a first cutting line comprising the curved periphery and said first cutting being in a direction vertical to faces of the material and said first cutting resulting in rollover at the first cutting line; and (B) in a second, final cutting operation, with another of said upper and lower punches cutting the semi-finished product to form the workpiece, said second cutting comprising cutting along a plurality of second cutting lines each having an end at the first cutting line and the second cutting lines each being oriented relative to the first cutting line so that each of the second cutting lines together with the first cutting line forms a respective corner of the part configured to interlock with another part, the corner having a radius which is small in relation to the thickness of the material, and said second cutting being in a direction opposite the direction of the cutting in operation (A) and wherein the other of said upper and lower punches contacts portions of the semi-finished product comprising the rollover resulting from operation (A) thereby to ameliorate the rollover resulting from operation (A).

* * * * *